United States Patent [19]

Thomas

[11] Patent Number: 4,863,096

[45] Date of Patent: Sep. 5, 1989

[54] MAILBOX INSERT

[75] Inventor: W. Lynn Thomas, Kearney, Nebr.

[73] Assignee: Ace Irrigation & Manufacturing Co., Kearney, Nebr.

[21] Appl. No.: 171,969

[22] Filed: Mar. 23, 1988

[51] Int. Cl.[4] ..... B65D 91/00

[52] U.S. Cl. ..... 232/17

[58] Field of Search ..... 232/17, 1 C, 1 R

[56] References Cited

U.S. PATENT DOCUMENTS 1,564,073 12/1925 Johnson ..... 232/17

4,026,461 5/1977 Hodge ..... 232/17

4,114,800 9/1978 Hodge ..... 232/17 X

*Primary Examiner*—Robert W. Gibson, Jr.

*Attorney, Agent, or Firm*—Bernard L. Kleinke; Jerry R. Potts; William Patrick Waters

[57] ABSTRACT

A mailbox insert includes a rigid plate adapted to be supported above the floor of the interior of the mailbox. The plate is composed of a rigid, corrugated material having a plurality of ridges and valleys. A plurality of legs depend from the underside of the plate to support the articles of mail resting above the plate. A plurality of holes or openings in the plate to provide drainage and ventilation.

9 Claims, 1 Drawing Sheet

MAILBOX INSERT

TECHNICAL FIELD

The present invention relates in general to a mailbox insert, and it more particularly relates to a device for protecting articles of mail, such as letters, magazines, newspapers and the like, from damage from adverse weather conditions.

A Disclosure Document was filed on Sept. 21, 1987, and was assigned number 177818.

BACKGROUND ART

There have been various different types and kinds of attachments and devices for mailboxes, both collection boxes and delivery boxes. For example, reference may be made to the following U.S. Pat. Nos. 459,550; 1,848,995; 2,561,007; 2,868,444; 3,982,690; 4,026,461; and 4,600,143.

However, none of the prior known mailbox attachments and devices have clearly addressed the problem of bad weather conditions causing the damage of the articles of mail temporarily stored in the mailbox. In this regard, snow, rain, slush and other adverse weather conditions can infiltrate the mailbox, and damage or destroy the contents thereof. For example, snow and ice can collect at the bottom floor at the interior of the mailbox. In this regard, an accumulation of moisture can damage or destroy the paper articles in the mailbox. During cold weather conditions, the metal floor of the box can cause the paper articles to stick or otherwise adhere to the bottom floor, in the presence of freezing moisture.

Also, snow can blow into the interior of the mailbox, and the articles of mail can freeze to the bottom floor of the box. Thus, the mail can be damaged, or delayed in its delivery.

During warmer weather conditions, rain often times infiltrates the box and collects at the bottom thereof. As a result, the articles stored in the box can be damaged due to the water accumulations.

Therefore, it would be highly desirable to have a device, which can be installed in a very convenient manner, without the need for highly trained personnel, for the purpose of preventing or at least greatly minimizing the problem of damage to the mail. Such a device should be relatively inexpensive to manufacture. The device should be very durable and enable the articles of mail to be well protected from the environment.

Any device which is used inside of a mailbox, especially a large, conventional collection box, would necessarily have to withstand the heavy weight of the articles of mail received in the box. In this regard, the large number of articles of mail ordinarily received in the collection box, has sufficient weight which could crush or at least damage a device disposed within the box. Also, it would have to withstand rough handling from personnel.

Such a mailbox insert would have to fit all existing conventional mailboxes. Once in place, it should remain there, even after the removal of the mail from the box. Also, when in place, the insert should only occupy a minimum or at least a small amount of valuable mail space within the box.

DISCLOSURE OF INVENTION

Therefore, the principal object of the present invention is to provide a new and improved mailbox insert, which helps protect mail articles deposited in a mailbox from being damaged or destroyed by weather conditions, without occupying too much space.

Another object of the present invention is to provide such a new and improved mailbox insert, which can be installed in existing mailboxes in a convenient and relatively inexpensive manner, and which is relatively strong mechanically to prevent or to resist damage from a large bulk of mail.

Briefly, the above and further objects of the present invention are realized by providing a mailbox insert, which can be readily installed by unskilled personnel in a small amount of space within the mailbox. The insert is relatively inexpensive to manufacture and can withstand the weight of the mail.

A mailbox insert includes a rigid plate adapted to be supported above the floor of the interior of the mailbox. The plate is composed of a rigid, corrugated material having a plurality of ridges and valleys. A plurality of legs depend from the underside of the plate to support the articles of mail resting above the plate. A plurality of holes or openings in the plate to provide drainage and ventilation.

As a result of the construction of the new mailbox insert, the inventive device can be used at the inside of a collection mailbox to support a large quantity of mail articles resting thereabove. In this regard, such a large quantity of mail articles can be relatively heavy in weight, and yet the inventive insert has sufficient strength to support the weight without breakage or damage, even after rough repeated use in all weather conditions.

The corrugated configuration of the plate provides the necessary strength. The plate rests above the mailbox floor to permit any accumulation of water or moisture to collect below the plate, and thus to keep the articles of mail dry and safe above the plate. The depending legs of the plate provide for support of the plate, and the corrugated configuration of the plate helps to prevent it from buckling or deforming.

Due to the corrugated configuration of the plate, the cross sectional profile is low to the mailbox floor. Thus, the inventive insert occupies only a small portion of the interior mail receiving space within the mailbox.

The perforations in the plate provide for drainage to allow any collected moisture or water to flow readily through the plate and be disposed thereunder, and thus away from the paper mail articles resting above the plate.

The plate is relatively inexpensive to manufacture from suitable materials, such as sheet metal. Thus, the plate is relatively inexpensive to manufacture, and is easily installed by merely lowering it onto the bottom floor of the mailbox.

BRIEF DESCRIPTION OF DRAWINGS

The above mentioned and other objects and features of this invention and the manner of attaining them will become apparent, and the invention itself will be best understood by reference to the following description of an embodiment of the invention in conjunction with the accompanying drawings, wherein.

BEST MODE FOR CARRYING OUT THE INVENTION

Figure 1:
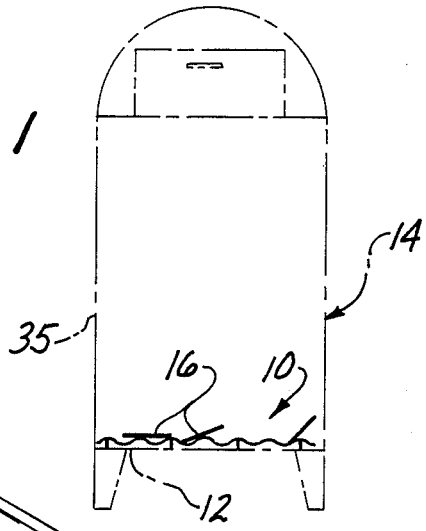
FIG. 1 is a elevational view of the mailbox insert, which is constructed in accordance with the present invention, and which is shown disposed within a collection mailbox shown in broken lines.
Figure 2:
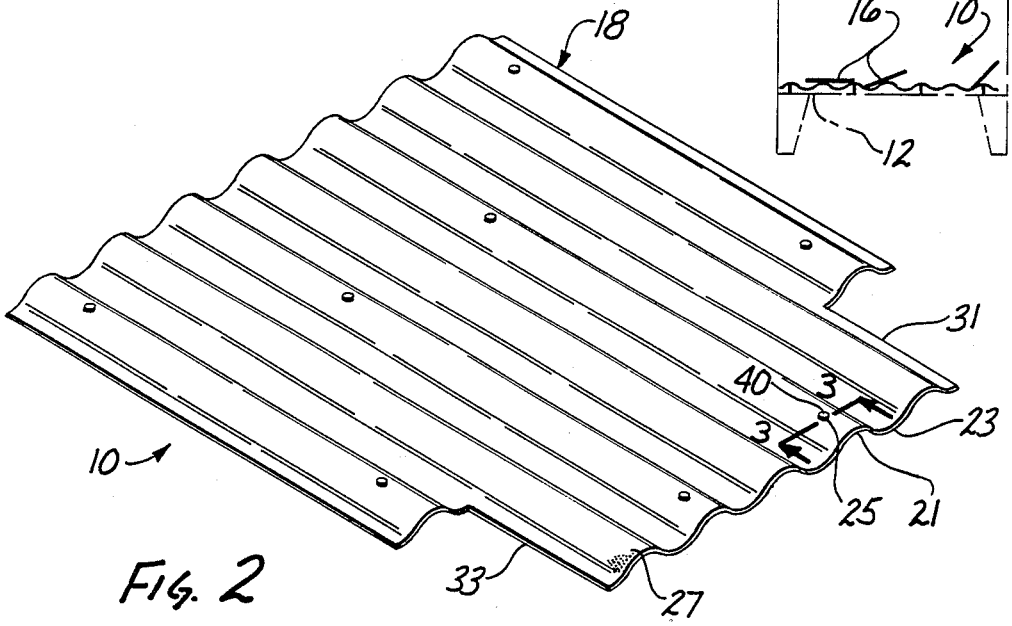
FIG. 2 is a greatly enlarged pictorial view of the mailbox insert of FIG. 1.

Referring now to the drawings, and more particularly to FIGS. 1 and 2 thereof, there is shown a mailbox insert 10, which is constructed in accordance with the present invention, and which is shown in FIG. 1 being disposed resting on a floor 12 at the interior of a collection mailbox 14.

The mailbox insert 10 is designed to support a plurality of articles of mail, such as articles 16 resting above and being supported from below, by the insert 10.

The insert 10 generally comprises a plate 18, which is composed of substantially rigid material, such as sheet metal. The plate 18 is corrugated in configuration, and has a series of alternating ridges, such as the ridge 21 and valleys, such as the valley 23.

Figure 3:
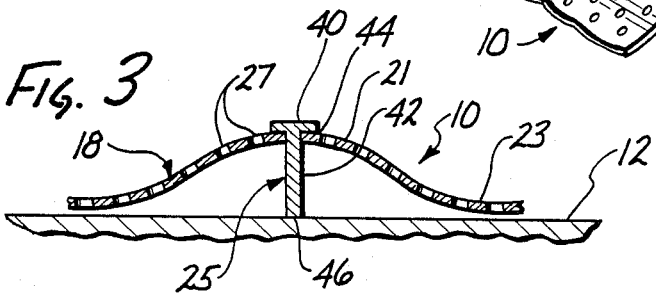
FIG. 3 is a still further enlarged sectional view of the mailbox insert of FIG. 2, taken substantially along line 3—3 thereof.

A series of legs, such as the leg 25 depends from the underside of the ridges, such as the ridge 21. As best seen in FIG. 3, the legs are used to support the underside of the ridges from the mailbox floor 12.

Figure 4:
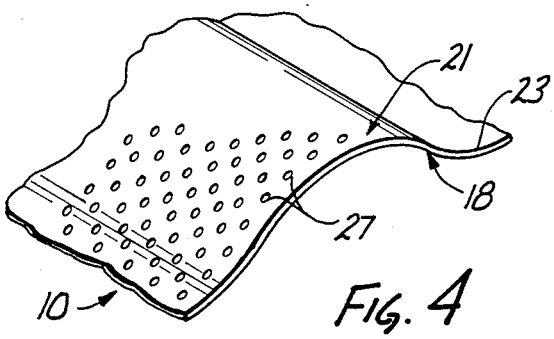
FIG. 4 is a still further enlarged pictorial fragmentary view of the mailbox insert of FIG. 2, illustrating the perforation therein.

As shown in FIG. 2, 3 and 4, the plate 18 is perforated by a series of evenly distributed openings or holes 27 to permit moisture and water to flow therethrough and collect under the plate 18 and away from the articles of mail resting thereabove. The holes 27 also serve to ventilate the moisture which may collect below the plate 18, and thus allow it to evaporate.

The plate has a pair of front cut-out portions 31 and 33, so that the overall shape in plan view of the plate 18 is complementary to the shape of the mailbox floor 12. Thus, the plate 18 fits snugly within the mailbox 14 and overlies the bottom floor 12, in such a manner that the mail articles 16 are not able to fit between the marginal edges of the plate 18 and the side walls, such as a side wall 35 of the mailbox 14.

Considering now the legs in greater detail, with reference to FIG. 3, the legs are all similar to one another, and only the leg 25 will now be described in greater detail. The leg 25 generally comprises a head portion 40 disposed above the plate 18, and an elongated generally-cylindrical body portion 42 which depends from the head portion 40 and extends through an opening 44 at the crest of the ridge 21 of the plate 18. A bottom distal end 46 o 25 rests directly on the upper surface of the floor 12.

The corrugated plate 18 and the legs, such as the legs 25, are all composed of rigid metal material.

In use, the insert 10 is positioned within the interior of the mailbox, and then lowered to the floor 12. The insert 10 then rests in overlying relationship on the floor 12.

The insert 12 is positioned with the bottom portions of the valleys, such as the valley 23, and the bottoms of the legs, such as the leg 25, resting on and engaging the floor 12. In this manner, the insert 10 is firmly supported by and engages the floor 12. The legs help support the insert from above the floor 12. Thus, the insert of the present invention can be used to support heavy loads of mail, without becoming damaged or otherwise malfunctioning.

Since the inventive insert rests directly on the floor 12, it does not occupy an unduly large amount of mail space within the interior of the mailbox. It can be installed in a very short period of time by untrained personnel.

While a particular embodiment of the present invention has been disclosed, it is to be understood that various different modifications are possible and are contemplated within the true spirit and scope of the appended claims. For example, various different materials may be used for the plate 18, and such materials may include suitable rigid plastic materials, such as Lexan, polyvinyl chloride (PVC), cryolac (ABS); and the legs also may be molded or otherwise formed from or into the body of the insert; and the legs may extend from either the ridge or valley portions of the insert. There is no intention, therefore, of limitations to the exact abstract or disclosure herein presented.

What is claimed is:

1. A mailbox insert adapted to rest on the bottom floor of a mailbox, comprising:
   - a plate composed of rigid material;
   - a plate having a series of ridges and valleys, said ridges being adapted to rest directly on the mailbox floor;
   - a plurality of legs depending from the undersides of said valley ridge portions; and
   - means defining a series of openings in said plate for permitting liquid to drain therethrough.

2. A mailbox insert according to claim 1, wherein said plate is corrugated.

3. A mailbox insert according to claim 2, wherein said plate is composed of sheet metal.

4. A mailbox insert according to claim 3, wherein each one of said legs includes a head and a depending generally cylindrical body portion terminating in a bottom foot portion.

5. A mailbox insert according to claim 4, wherein each one of said legs is composed of metal material.

6. A mailbox insert according to claim 5, wherein said plate is adapted to overlie the body of mailbox bottom floor and said plate is complementary shaped relative thereto.

7. A mailbox insert according to claim 6, wherein said plate includes a pair of cut-out portions.

8. A mailbox insert according to claim 7, wherein each one of said openings is relatively small and closely spaced relative to one another.

9. A method of using a mailbox insert within a mailbox, comprising:
   - using an insert having a series of alternating ridges and valleys, and having a group of legs depending from the undersides of said ridges;
   - positioning the insert within the interior of the mailbox; and
   - resting the insert on the floor of the mailbox with the valleys and bottom distal ends of the legs engaging the floor.

* * * * *

UNITED STATES PATENT AND TRADEMARK OFFICE

CERTIFICATE OF CORRECTION

PATENT NO. : 4,863,096

DATED : 09/05/89

INVENTOR(S) : W. Lynn Thomas

It is certified that error appears in the above-identified patent and that said Letters Patent is hereby corrected as shown below:

Column 3, line 8, after "the", delete "perforation", and substitute therefor --perforations--.

Column 3, line 53, after "46", delete "o", and substitute therefor --of the leg--.

Column 4, line 28, before "plate", delete "a", and substitute therefor --said--.

Signed and Sealed this

Twenty-fifth Day of December, 1990

*Attest:*

HARRY F. MANBECK, JR.

*Attesting Officer*

*Commissioner of Patents and Trademarks*